US010023426B2

(12) United States Patent
Boccato

(10) Patent No.: US 10,023,426 B2
(45) Date of Patent: Jul. 17, 2018

(54) COIL MAKING APPARATUS AND METHOD

(71) Applicant: CURTI COSTRUZIONI MECCANICHE S.P.A., Castel Bolognese (IT)

(72) Inventor: Enrico Boccato, Castel Bolognese (IT)

(73) Assignee: CURTI COSTRUZIONI MECCANICHE S.P.A., Castel Bolognese (IT)

( * ) Notice: Subject to any disclaimer, the term of this patent is extended or adjusted under 35 U.S.C. 154(b) by 0 days.

(21) Appl. No.: 15/310,278

(22) PCT Filed: May 12, 2014

(86) PCT No.: PCT/EP2014/059671

§ 371 (c)(1),
(2) Date: Nov. 10, 2016

(87) PCT Pub. No.: WO2015/172811

PCT Pub. Date: Nov. 19, 2015

(65) Prior Publication Data

US 2017/0190538 A1 Jul. 6, 2017

(51) Int. Cl.
*B65H 61/00* (2006.01)
*B65H 54/58* (2006.01)
(Continued)

(52) U.S. Cl.
CPC ..... *B65H 61/00* (2013.01); *B65H 54/58* (2013.01); *B65H 54/62* (2013.01); *B65H 54/71* (2013.01)

(58) Field of Classification Search
CPC ..... B65H 54/58; B65H 54/62; B65H 54/71; B65H 61/00
See application file for complete search history.

(56) References Cited

U.S. PATENT DOCUMENTS 3,975,883 A 8/1976 Besnyo et al.
4,276,333 A 6/1981 Cobean
(Continued)

FOREIGN PATENT DOCUMENTS

DE 102006058924 A1 6/2008
EP 1452474 A1 9/2004
WO WO2010/001342 A1 1/2010

OTHER PUBLICATIONS

Machine Translation of DE 10 2006 058 924 A1. Jun. 19, 2008. (Year: 2008).*

(Continued)

*Primary Examiner* — William E Dondero

(57) ABSTRACT

An apparatus (1) and a method for coiling a cable (2) or a wire into a coil (3) having a plurality of turns (3*a*) and two free ends (4, 5) formed by a leading end (4) and a trailing end (5) of said cable are disclosed. The apparatus comprises a rotatable coil former (6) around which a cable is coiled; means (9) to measure the length of the coiled cable (2) or wire; first holding means (10) positioned on said coil former (6) for holding the leading end (4) of the cable, second holding means (12), separate from said coil former (6) for receiving and holding the leading end (4) of the cable (2), which are movable. Cutting means (14) for cutting the coiled cable to provide a trailing end (5) of the cable are also provided. The apparatus further comprises means (7) to adjust the diameter (D1, D2) of the coil former (6) and control means (18) to set said adjusting means (7) of the diameter of the coil former (6), to provide the required length of the cable and the required length of the said free ends (4, 5) of the coiled cable.

26 Claims, 5 Drawing Sheets

(51) Int. Cl.
*B65H 54/71* (2006.01)
*B65H 54/62* (2006.01)

(56) References Cited

U.S. PATENT DOCUMENTS

| | | | |
|---|---|---|---|
| 5,063,974 | A | 11/1991 | Buckwitz et al. |
| 5,427,327 | A | 6/1995 | Anderson et al. |
| 6,481,662 | B1 | 11/2002 | Kles et al. |
| 6,948,675 | B2 | 9/2005 | Frommenwiler |

OTHER PUBLICATIONS

T abstract DE10200605892.
T abstract EP1452474 A1.
International Search Report from parent application PCT/EP2014/059671, dated Mar. 11, 2015.
International Preliminary Report on Patentability from parent application PCT/EP2014/059671, dated Nov. 15, 2016.
Written Opinion of the International Searching Authority from parent application PCT/EP2014/059671.
Office Action dated Feb. 27, 2018 for corresponding patent application No. 14723091.6.

* cited by examiner

COIL MAKING APPARATUS AND METHOD

RELATED APPLICATION(S)

This application is the US national phase application of international application number PCT/EP2014/059671, filed 12 May 2014, which designates the US and the contents of which are hereby incorporated by reference as if set forth in their entirety.

FIELD OF THE INVENTION

The present invention relates to a coil making apparatus and method, in particular, to an apparatus and a method for coiling a cable or wire or similar conducting devices, to provide a coil having two free ends that can be processed.

BACKGROUND ART

It is known to wind cables or wires into coils for further storing, shipping or further processing. It is known to make coils by winding the cable or wire into a drum-like cavity of a non-rotating winding apparatus, as disclosed e.g. by DE 42 35 007; this method is not suitable for preparing coils with ends ready for further processing, also because it is not possible to control the radius of curvature of the cable. The radius of curvature can be controlled by using a coil forming apparatus where the cable is wound around a coil former; once the coil has been formed around the forming nucleus, the former's diameter is decreased to allow safe removal of the coil.

In fact, one problem faced by the known methods and apparatuses is to provide a required length for the two cable ends for further processing of the cable at its two ends. U.S. Pat. No. 6,948,675 discloses an apparatus for making coils from a length of cable (namely fiber optic cable); the apparatus has a coil former and two grippers for the two ends of the cable, the grippers are movable by means of relevant carriages on rails, so as to adjust the lengths of the two ends to be the same or almost the same. In this embodiment, the two grippers hold the two ends of the cable and are aligned to each other during the final step of adjusting the length of the free ends.

WO2010/001342 discloses an apparatus for coiling pieces of cable or of wire. The cable is first cut into the desired length and then wound around a coil former; the coil former has a diameter that can be modified and controlled. According to WO'342, the diameter of the coil former is changed during the winding of the cable in order to have a final free end (trailing end) of the coil having the required length, substantially identical to the first free end (leading end) of the coil.

Actually, changing the diameter of the coil during the forming of the coil is a step very difficult to achieve, especially once a couple of windings have been provided on the coil former. Another problem of this document is that the cable (or wire) has to be cut into the desired length in advance; a cut cable may be difficult to handle, especially if the cable is longer than a few meters, e.g. longer than 3-4 meters.

It is an aim of the present invention to solve the above problems and to provide an apparatus and a process in which a continuous cable is fed to the coil-forming machine, is coiled and can be cut into the desired length with great accuracy, and wherein the two cable's ends protrude from the same side of the coil and have a predetermined length, and preferably the same length.

SUMMARY OF THE INVENTION

The above stated aim is reached by means of the apparatus and process of the present invention. A further object of the invention is a coil (coiled cable). The coil according to the invention is obtainable by the method for coiling a cable according to the invention.

The apparatus of the invention comprises a rotatable coil former around which a cable is coiled; means to measure the length of the coiled cable or wire; first holding means on the rotating part of the coil former for holding the leading end of the cable, second holding means, separate from said coiler, for receiving the leading end of the cable, said second holding means being movable, cutting means for cutting the coiled cable to provide a trailing end of the cable.

The apparatus further comprises means to adjust the diameter of the coil former and control means to set said adjusting means of the diameter of the coil former, to provide the required length of the cable and the required length of the said free ends of the coiled cable.

According to the present invention, the cable is wound a pre-set number of times around a coil former having a first diameter to provide a first coil having a pre-set number of windings, then the cable is cut to provide two free ends of the coil: said free ends have a required length and are spaced from each other by a required distance. Length and spacing distance of the free ends of the coil are chosen as a function of the machine that will carry out the further processing of said ends of the coil; known exemplary further processing include stripping of the cable's ends, adding metal connectors and over-moulding of the plastic to form the final plug (male or/and female). In a preferred embodiment, the cutting means and the second holding means are spaced from the coil by a distance, or moved to be spaced from the coil by a distance, that is identical or substantially identical to the required length for the free ends of the coil.

The length of the cable is measured during or after winding the cable on the coil former and before cutting it; the length of the cable is a function of the number of windings of the coil, of the diameter of the coil former and of the diameter of the cable. An example of coil is shown in FIG. 7. There are provided 5 windings along the width of the coil. This means that at each turn of the coil former, the diameter of the "core" around which the cable is coiled, is increased by the diameter of the previous windings. The diameter of the cable is not constant. The diameter can change within a range that is set by the cable producer. For example, a cable that has a formal, i.e. nominal, diameter of 10 mm may easily reach a diameter of about 10.4 mm.

The increased cable diameter results in an increase of the length of the cable, after an identical number of windings (turns); as an example, for a cable that is 20 meters long, or more, a difference in length of 30-50 cm can easily be reached for the wound cable. If the length differs from the required one, e.g. it is shorter or longer, for example by a value that is greater than an acceptable value that was previously set, the diameter of the coil former is modified according to the result obtained, after the coil has been removed from the coil former, i.e. before another coil is formed.

Thus, the diameter of the coil is increased or decreased depending on the length of the piece of cable that has been coiled; the modification of the coiler diameter is carried out at the end of the coiling step for which the cable length has been measured. In other words, the adjustment will be effective on the coiling process that follows the process where the cable length has been measured.

Advantageously, the apparatus and the method according to the invention, the adjustment of the diameter of the coil former also allows to obtain the required length for the free ends of the cable.

In particular, the adjustment of the diameter allows to have the free ends of the cable in a predetermined position, with respect to the coil, thus allowing the automatic processing of the free ends for example in a cable processing device.

Further advantageous details of the invention are recited in the dependent claims.

The elements which have been mentioned above and those which are claimed and described in the following exemplary embodiments, can be combined together to provide further embodiments that fall within the scope of this invention.

The apparatus and the process are not restricted to cable-like conductors, e.g. coaxial cables, or to cables having a circular cross-section as those shown in the following description and figures.

BRIEF DESCRIPTION OF THE FIGURES

Further details, features and advantages of the invention are disclosed in the following description and drawings, in which the invention process and apparatus are explained by way of example, wherein.

DETAILED DESCRIPTION OF THE PRESENT INVENTION

Figure 1:
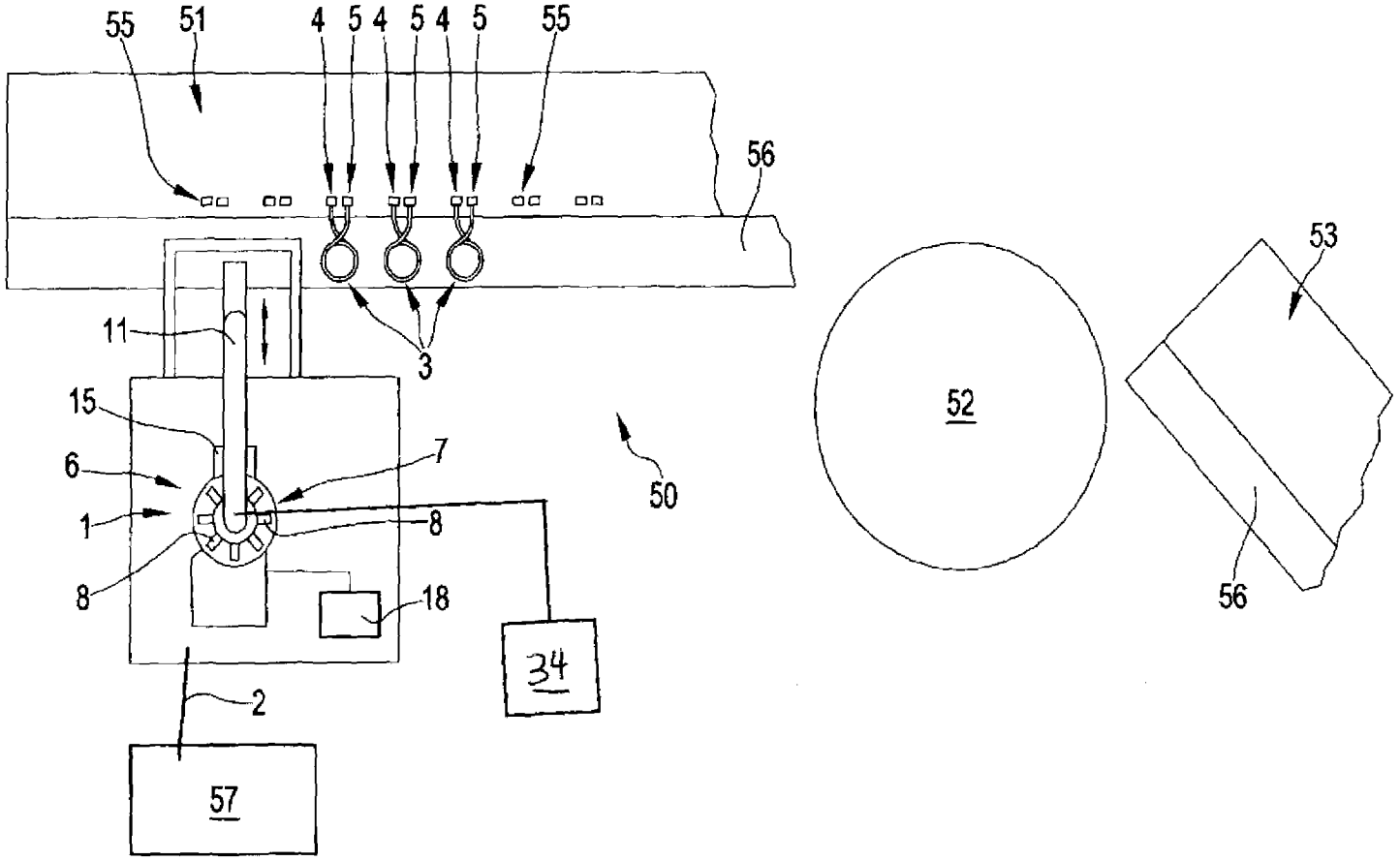
FIG. 1 is schematic top view of a possible embodiment of the apparatus for coiling a cable according to the invention in cable processing device.

As shown in the figures, according to a possible embodiment of the apparatus 1 for coiling a cable 2, or a wire, into a coil 3, it comprises a rotatable coil former 6 around which a cable is coiled (wound) to form a plurality of turns 3*a* and two free ends 4, 5, formed by a leading end 4 and a trailing end 5 of the cable 2.

It has to be noted that in the following the term "free ends" is used to indicate the trailing end and leading end, in fact, the free ends of the coil are formed by a leading end of the cable and a trailing end of the cable.

The cable 2 intended to be coiled can be supplied, preferably continuously, in a known way from one or more reels 57, or other supply means not shown in the figures.

The apparatus 1 further comprises means 9 to measure the length of the coiled cable 2 or wire, which are known in the art. The means 9 measure the length of the cable 2 supplied to the coil former 6, and preferably the cable length passing cutting means 14 of the apparatus intended to provide the trailing end 5 of the cable 2 for the formation of the coil.

According to a possible embodiment, as for example shown in the attached figures measuring means 9 comprise a measuring wheel to easily measure the cable length. However, different position of the measuring means 9 can be used, provided that the distance between the cutting means and the measuring means is known and the cable length between the leading end and the trailing end provided by the cutting means can be determined.

According to different possible embodiments, the measuring means 9 can be also provided in correspondence of the cutting means 14.

In fact, as mentioned above, the cable 2 is preferably supplied continuously to the coil former 6 and it is cut by the cutting means 14 of the apparatus 1.

In fact, the apparatus 1 is further provided with cutting means 14, for example comprising one or more blades, intended to cut the cable 2 thus forming a trailing end 5 thereof.

According to different possible embodiments, cutting means 14 can be automatically operated, such as for example by means of an actuator.

The coiling apparatus 1 further comprises first holding means 10, preferably positioned on the coil former 6, for holding the leading end 4 of the cable, while it is rotated on the coil former. Also in this case, different holding means, known in the art can be used, such are for example grippers allowing to engage and to release the leading end 4 of the cable.

The operation of the first holding means can be carried out by suitable actuator, not shown in the figures.

According to an aspect of the invention, the first holding means 10 are arranged in correspondence of the external diameter, i.e. the external circumference of the coil former 6, and preferably at the maximum diameter (circumference) of the coil former 6. The coil former comprises a lower circular flange 6*a* for supporting the lower turns 3*a* of the coil 3 and, as it will be described later, the coil former comprises a cylindrical surface on which the cable is coiled, thus providing the internal support for the coil.

The apparatus further comprises second holding means 12, separate from said coil former 6, for receiving and holding the leading end 4 of the cable 2, from the first holding means 10.

It has to be noted that, even if not shown in the figure, suitable transporting means, such as for example a mechanical arm can be provided to transport the leading end of the cable from the supply reel 57, or from the cutting means 14, or suitable support means 13, to the first holding means 10 arranged on the coil former 6.

As already mentioned in connection to the first holding means 10, also the second holding means 12 can have in different configurations, provided that they are able to selectively hold and release the cable leading end 4.

The second holding means 12 are movable with respect to the coil former 6, preferably between at least a first position in which they are close to the first holding means 10 allowing the passage of the cable leading end 4 from the first holding means 10 to the second holding means 12, and at least one second position where the second holding means 12 and thus the leading end 4 are arranged at distance from the coil former 6. According to a possible embodiment the second holding means 12 are movable along a guide 12*a*, preferable a rectilinear guide. However, different configuration of the second holding means, and of the movement thereof, can be provided.

It has to be noted that the second holding means 12 are moved to be spaced from the coil 3 (and thus from the coil former 6) by a distance that is identical or substantially identical to the required length for the leading end 4 of the coil.

It has to be noted that, according to another possible embodiment not shown in the figures, the second holding means can be fixed and spaced from the coil by a distance identical or substantially identical to the required length for the leading end 4 of the coil, and suitable transferring means are used to transport the leading end 4 of the cable from the first holding means 10 to the second holding means 12.

The same applies to the cutting means 14 of the apparatus. In fact, the cutting means 14 are spaced from the coil (and also form the coil former) by a distance, or moved to be spaced from the coil by a distance, that is identical or substantially identical to the required length for the trailing end 5 of the coil.

In other words, according to the apparatus of the invention, the position of the cutting means 14 and of the second holding means 12 are predetermined so that the required length of the free ends 4, 5 (leading end and trailing end of the cable) are predetermined.

Figure 3:
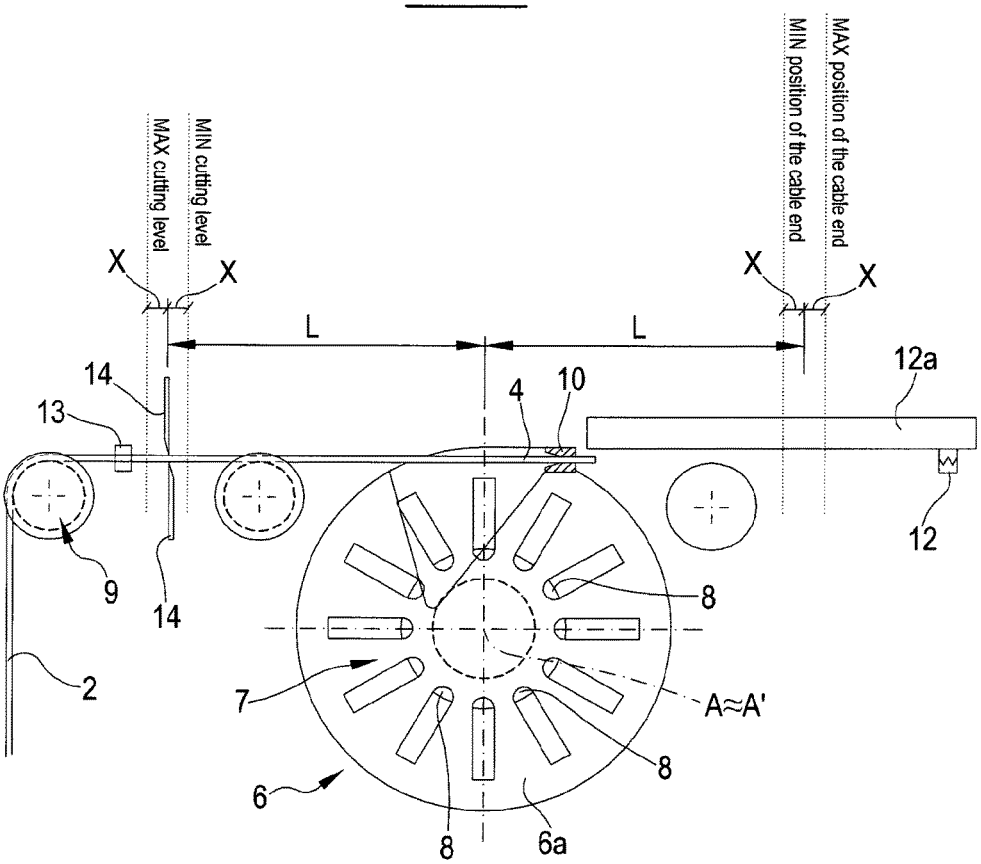
FIGS. 3, 4, 5 and 6 shows four steps of the coiling process, respectively wherein the leading end of the cable is transferred to the first holding means arranged on the coil former, the coil former is rotated to form the coil turns, the leading end of the cable is transferred to the second holding means arranged outside the coil former, the position of the second holding means is adjusted to substantially corresponds to the required length of the free end of the cable.

According to a possible embodiment, the position of the cutting means 14 and/or the position of the second holding means 12 is adjustable within a range that is L−X mm and L+X mm, wherein L is the required length of the free ends 4, 5 of the cable and X is the variation for the required length L (see for example FIG. 3). In other words, the value X is a variation, and in particular an accepted variation, of the cable length L which can be set by the apparatus according to the invention. According to a possible embodiment L±X is the range within the cable length can be set.

However, as already discussed above, during the coiling of the cable around the coil former to form the turns 3*a*, variations in the cable diameter (for example with the tolerance provided by the cable manufacturer) and also different relative positions between the coiled cable, i.e. the position of one turn with respect to another, would inevitably lead to a modification in the cable length. This problem is particular sensed if the coiled cable is very long, such as for example with cable length over 5 meters, and it considerably increases if the cable is longer than 10 meters, or about 20, or about 30 meters or even longer.

Advantageously, to obtain coils 3 having a required length of the cable and also the required length of the trailing end and of the leading end, which are arranged outside the coil turns, the apparatus according to the invention comprises means 7 to adjust the diameter D1, D2 of the coil former 6 and control means 18 (schematically shown only in FIG. 1) to set said adjusting means 7 of the diameter of the coil former 6, to provide the required length of the cable and the required length of the free ends 4, 5 of the coiled cable.

The control means 18, for example a control unit, is able to set the adjusting means 7 of the diameter of the coil thus providing a final coil with the required total length and also having both free ends 4, 5 having the required length.

More in detail, the coil former 6 is rotated about a central axis A, which substantially correspond to the central axis A' of the coil 3 formed on it. In fact, the coil former is provided with a lateral cylindrical surface on which the cable is wound to form the turns 3*a*. According to a possible embodiment, as also shown in the figure, the adjusting means 7 of the diameter of the coil former modify the diameter of the cylindrical surface on which the cable is coiled.

According to preferred embodiment, as for example shown in the figures, the means 7 for adjusting the diameter of the coil former 6 comprises a plurality of coil supporting elements 8 forming the cylindrical surface on which the cable is coiled (see in particular FIGS. 2-6).

In other words, the supporting elements 8 are tangent to a cylindrical surface on which the coil 3 is formed and therefore the inner (internal) diameter Din of the coil corresponds to the diameter of the surface defined by the supporting elements 8.

The supporting elements 8 are preferably radially arranged with respect to the central axis A of the coil former 6 and they are movable, preferably radially, to adjust the diameter of the coil former 6.

Suitable moving means such as motor means 34, are provided to move, preferably radially, the coil supporting elements 8 with respect to the central axis A' (A) of the coil 3 (coil former 6).

The movement of the coil supporting elements 8 can be obtained by a rotation or a linear movement, or by a combination of linear and rotation movements.

Advantageously, in the coiling apparatus according to the invention, the modification of the diameter of the coil former is carried out in a simple and quick way by acting on said adjusting means 7 of the diameter.

Figure 2:
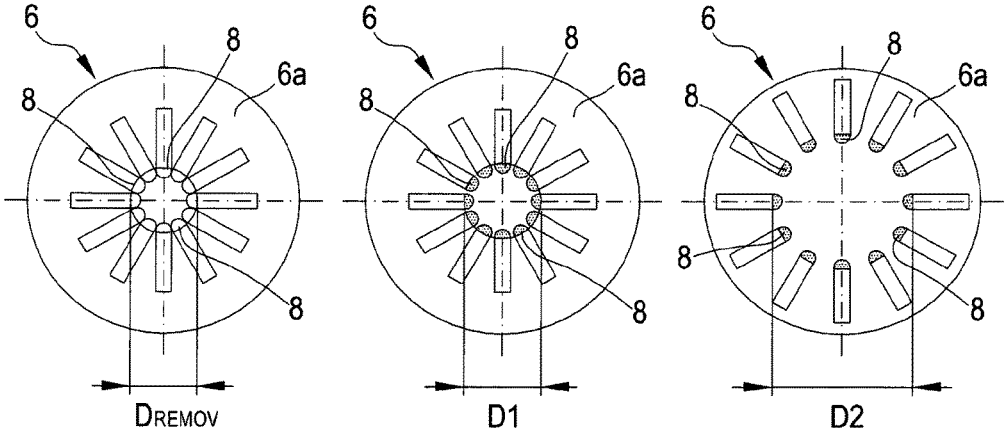
FIG. 2 shows, three side views of an embodiment of the coil former, wherein the means for adjusting the diameter, and in particular the plurality of coil supporting elements, are shown in three different positions, two for coiling the cable and one (left side of the figure) to remove the formed coil from the coil former.

FIG. 2 shows the coil former 6 with the adjusting means 7 in three different positions. In particular, the coil supporting elements 8 can be moved to form the circular (cylindrical) surface on which the cable is coiled having a first diameter D1 (see central image of FIG. 2) and of a second diameter D2 (shown in the right end image of FIG. 2), greater than the diameter D1.

It has to be noted that supporting elements 8 can be moved in a plurality of intermediate positions, between a maximum diameter and a minimum diameter, in order to provide a fine adjustment of the diameter of the coil former.

According to an aspect of the invention, the adjusting means 7 and in particular the coil supporting elements 8 are movable between a minimum diameter of 110 mm and a maximum diameter of 200 mm. However, different dimensions can be provided according to different configurations of the apparatus 1.

Additionally, the coil supporting elements 8 are also movable to a diameter less than the minimum diameter on which the cable can be coiled. This diameter is used to remove the formed coil from the coil former. For example, the left-hand image of FIG. 2 shows the coil supporting elements 8 in a position in which the diameter Dremov is less than the minimum diameter used for coiling the cable, thus allowing the removal of the formed coil from the coil former 6.

According to a preferred embodiment, the adjustment of the diameter of the coil former, in order to obtain the required cable length and also the required lengths of the free ends 4, 5 is performed by taking into account the measured cable length of the actual formed coil and to adjust the diameter for a subsequent coil to be formed on the coil former.

In fact, according to a possible embodiment, the control means 18 set the adjusting means 7 to adjust the diameter for a subsequent coil to be formed on the coil former 6 on the basis of the cable's measured length of the actual processed coil compared to the required length of the cable.

By doing so, the adjustment of the diameter for subsequent coil to be formed, based on the comparison of the measured cable length with the required cable length, allows to correct length errors. The adjustment is preferably repeated for each coil, so that the subsequent coil to be coiled is formed on a diameter adjusted taking into account the length errors determined for the precedent coil.

According to an aspect of the invention, also the actual length of the free ends 4, 5 of the cable compared to the required length of the free ends 4, 5 of the cable can be used by the control means 18 to adjust the diameter.

According to an aspect to the present invention, the control means 18 comprises a memory portion whereby the required length of cable for the coil is memorized (stored). It has to be noted that a plurality of required lengths values can be stored on the control means according to different coil dimensions which can be produced by the apparatus 1. As mentioned above, the control means 18 compare the cable's measured length with the required cable length, preferably stored on said memory portion.

According to a possible embodiment, also the length of the free ends 4, 5 of the cable of the actual processed coil can be compared to the required length of the free ends 4, 5 (which can be also stored in the memory portion of the control means 18) of the coiled cable to adjust the diameter.

As for example shown in the FIGS. 3-6, the supply way (orientation) of the cable and the exit way of the cable from the coil are equal if seen on a plane perpendicular to the rotation axis A of the coil former 6. In the embodiment shown in the FIGS. 3-6, the cable is supplied moving from left to right and the cable is also removed from the coil former moving from left to right.

The supply direction and the exit direction of the cable are preferably parallel, or coincident as for example in the embodiment shown in the FIGS. 3-6, wherein the leading end 4 engaged by the second holding means 12 and the trailing end cut by the cutting means 14 are arranged substantially, on the same rectilinear direction.

Figure 8:
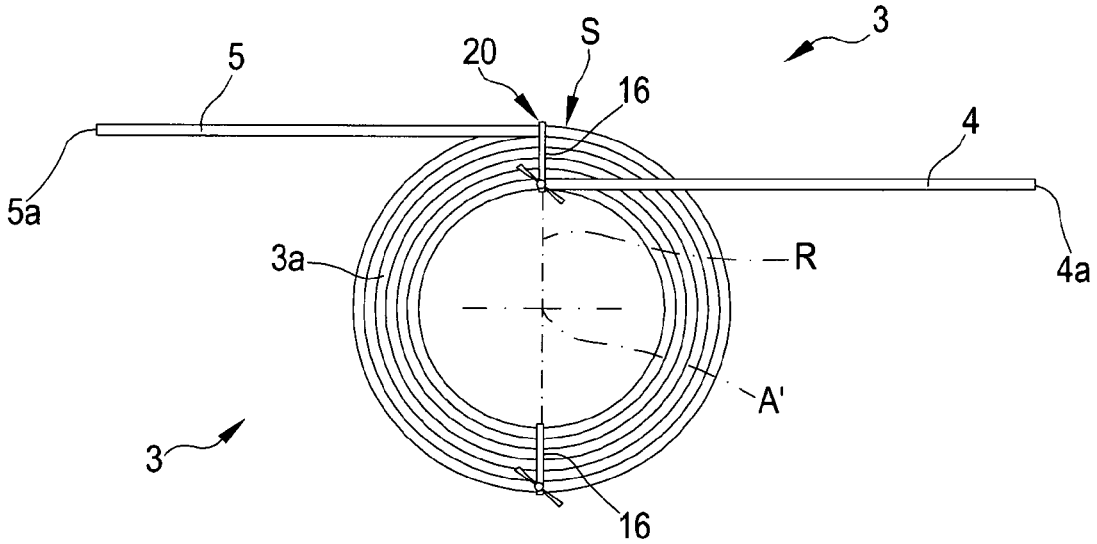
FIG. 8 is a view from above of a coil formed by an apparatus according to the invention, wherein the length of the leading end and of the trailing end are shown form the same exit area for the coil.

The coil 3 according to the invention, which can be produced by the apparatus according to the invention, and with the method according to the invention, is provided (as better shown in FIGS. 8 and 9) with a plurality of turns 3*a* and two free ends 4, 5 formed by a leading end 4 and a trailing end 5 of a cable 2 or a wire, preferably having the same exit area 20.

In other words, the arrangement of the cutting means 14 of the cable and of the second holding means 12 of the apparatus 1, to be substantially opposite one to another with reference to the coil former, allows the trailing end 5 and the leading end 4 of the cable 2 to exit the coil substantially in correspondence of the same exit area 20. In other words, the leading end and the trailing end of the coil are departing from the turns 3*a*, i.e. they are exiting the turns of the coil substantially in correspondence of the same (common) exit area 20.

The term "exit area" is used herein to indicate the area in correspondence of which the leading end 4 and the trailing end 5 of the coil do not follow the coiled (rounded) shape of the turns 3*a* and exit outside the coil.

According to a preferred aspect of the invention, the exit area 20 of the trailing end 5 and of the leading end 4 from the coil is arranged substantially on a radial axis R passing through the central axis A of the coil former, which substantially corresponding to the axis A' of the coil 3.

In other words, the trailing end and the leading end exit the in correspondence of the same radius departing from the central axis A of the coil former 6 (the control axis A' of the coil).

As shown in the figures, the leading end 4 is arranged closer to the central axis A (A'), in correspondence of the internal surface (internal diameter Din) of the coil, and the trailing end is arranged in correspondence of the external surface (external diameter Dext) of the coil and they are exiting the coil in the same area 20 defined by a radial axis R.

It has also to be noted that trailing end 5 and the leading end 4 extend opposite one to another with respect to same exit area 20 from the coil.

As for example visible in the FIGS. 3-6, according to an aspect of the invention, in the apparatus 1 the cutting means 14 and the second holding means 12 are arranged on two opposite sides with respect to the same (common) exit area 20 of the trailing end 5 and of the leading end 4 from the coil 3. In particular, the cutting means 14 and the second holding means 12 are arranged on two opposite side with respect to the radius passing through the exit area 20.

Figure 6:
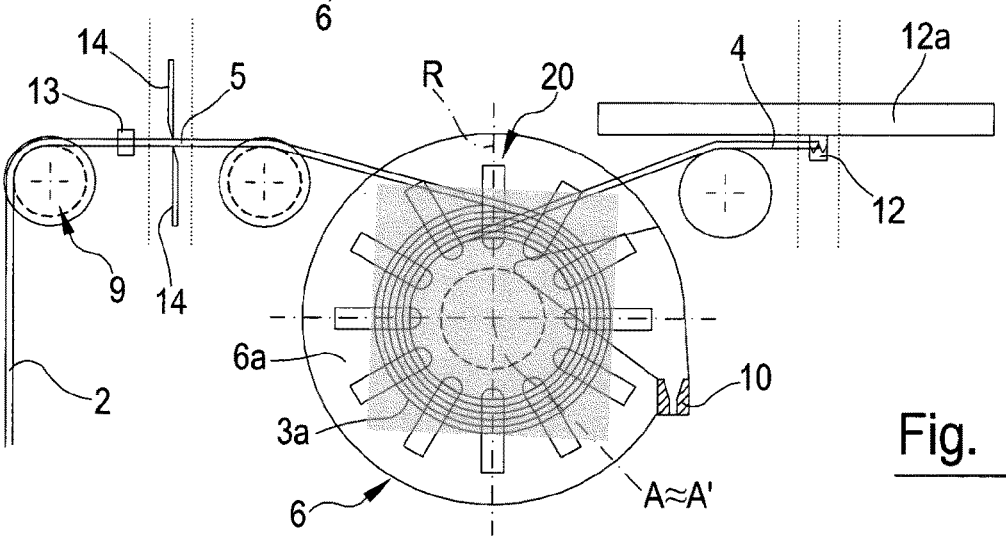

In fact, as shown in particular in FIG. 6, the cutting means 14 are arranged on the left side with respect to the exit area 20, and in a particular on the left side of radius passing through the exit area 20, and the second holding means 12 are arranged on the right side with respect to the exit area 20.

Additionally, the apparatus according to invention further comprises tying means 15 (schematically shown in FIG. 1) to provide at least one tie 16 on the coil 3. Preferably, the tying means 15 are arranged to provide at least one tie 16 in correspondence of the same exit area 20 of the trailing end 5 and of the leading end 5 from the coil. In other words, the exit area 20 can be seen as to be defined by the tie 16 arranged on the coil 3. In fact, the tie 16 keeps the turns 3*a* packed while allowing the trailing end 5 and the leading end 4 to exit from the coil 3.

The tie can be for example comprise a strip of plastic material, optionally reinforced with a metal core. However different configuration of the tie 16 can be provided. According to a possible embodiment, not shown in the figure the trailing end 5 and the leading end 4 can exit the coil 3 at two different area, preferably arranged along a semicircle part of the coil (and also of the coil former), preferably not in correspondence of two diametrically opposite points of the semicircle part, i.e. not in correspondence of the diameter of the semicircle part.

According to an advantageous aspect of the present invention, the apparatus and the relative coiling method allows to obtain coils 3 having a predetermined length while having the free ends 4 and 5 at required length, so that the ends can be arranged in a desired predetermined position to be processed outside the apparatus 1.

In particular, the control means 18 can adjust the diameter of the coil former so as the required length of the free ends is obtained. Advantageously, the required length of the free ends 4, 5 of the cable is such that the extremities 4*a*, 5*a* of the trailing end 5 and of the leading end 4 are arranged at the same distance D from the external surface S of the coil. The external surface of the coil can be identified by the external diameter Dext of the coil 3, see for example FIG. 9.

Figure 9:
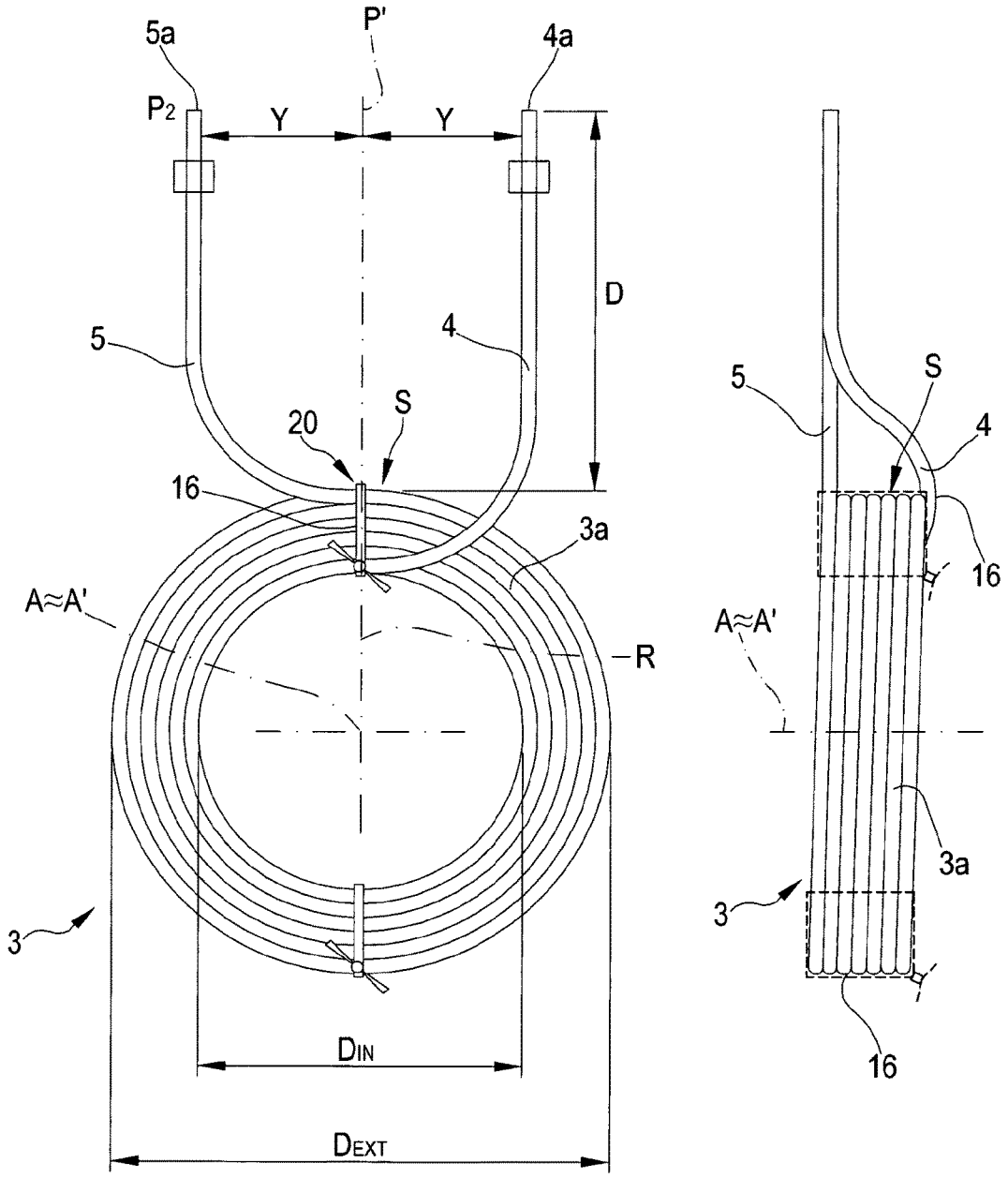
FIG. 9 shows a top view and a lateral view of a coil formed in an apparatus according to the invention, wherein the extremities of the trailing end and of the leading end are arranged at the same distance (D) from the external surface of the coil in a predetermined position.

As for example shown in FIG. 9, the distance D is measured between the external surface S of the coil and a plane P that is tangent to the external surface of the coil, preferably in correspondence of the exit area 20 of the free ends 4, 5 from the coil. The plane P is externally spaced from the external surface S at distance D.

According to a further aspect of the invention, the required length of the free ends 4, 5 of the cable is such that the trailing end 5 and the leading end 4 are arranged at the same lateral distance Y from a plane P' passing through the central axis A' of the coil (central axis A of the coil former 6) and the exit area 20 of the free ends 4, 5 from the coil, see for example FIG. 9.

The apparatus further comprises transport means 11 (schematically shown in FIG. 1) of the formed coil 3 from the coil former to the outside, preferably to another station of a processing device to which the coil apparatus 1 is connected.

Figure 7:
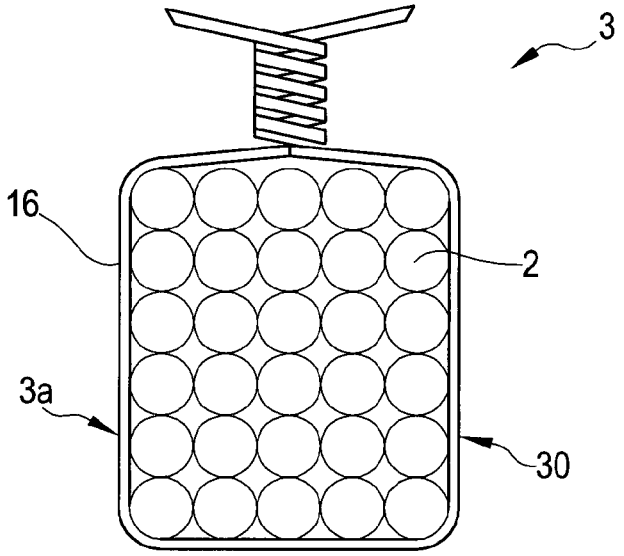
FIG. 7 shows a section view, in correspondence of a tie, of a coil formed in an apparatus according to the invention.

FIG. 7 shows a section, from a plane passing through the central axis A' of the coil 3, showing the turns 3*a* formed by the coiled cable. The number of "columns" and "rows" of superimposed turns and laterally arranged turns can be varied according to different configurations.

With particular reference to FIGS. 3-6 a possible embodiment of the method for coiling a cable 2 will be now described.

The method according to the invention for coiling a cable 2 or a wire into a coil 3 by means of an apparatus 1 according to the invention comprises the step of transferring the leading end 4 of the cable 2 to the first holding means 10, positioned on the rotatable coil former 6 for holding the leading end 4 of the cable, see FIG. 3. In particular a cable 2 is supplied from a reel 57, or similar means, in a known way.

Figure 4:
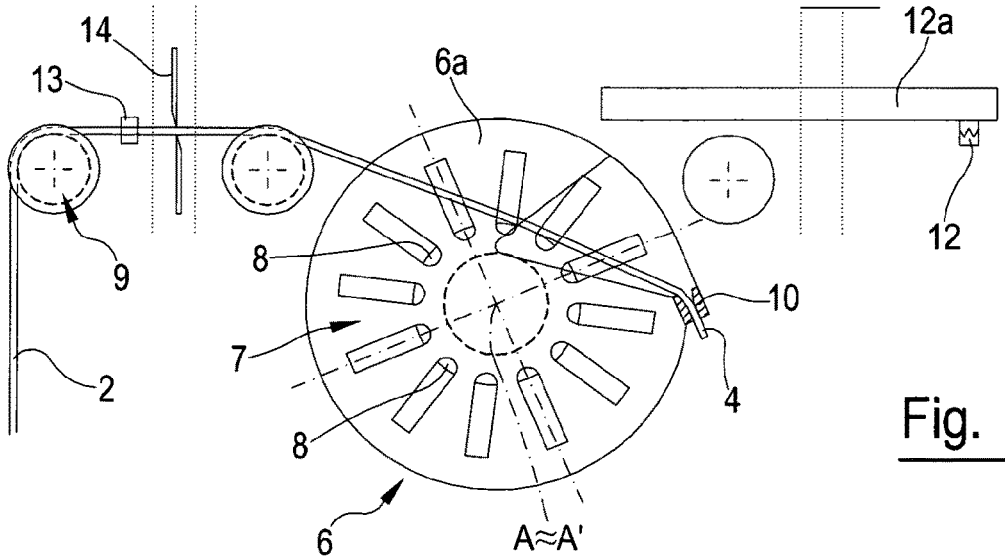
Figure 5:
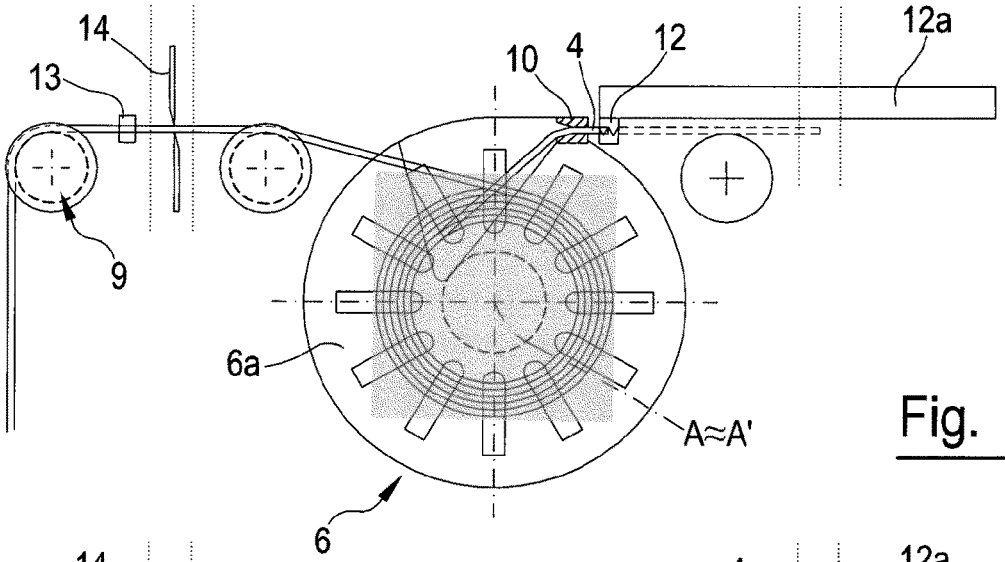

The coil former 6 is then rotated about the central axis A for coiling the cable 2, thus forming a plurality of turns 3*a* (see FIG. 4). Said control means 18 controls the number of rotation of the cable.

Subsequently the leading end 4 of the cable 2 is transferred to the second movable holding means 12, separate from the coil former 6. It has to be noted that the second holding means 12 are moved in a position close to the first holding means in order to allow the transfer of the leading end 4 from the first holding means 10 to the second holding means 12, as for example shown in FIG. 5.

According to another possible embodiment, the second holding means 12 can be fixed and suitable transferring means, for example a mechanical arm, can be provided to transfer the leading end 4 from the first holding means 10 to the second holding means 12.

According to an aspect of the method, the second holding means 12 are spaced from the coil by a distance, or they are moved to be spaced from the coil by a distance, that is identical or substantially identical to the required length for the leading end 4 of the coil.

The second holding means 12 are shown in position distanced from the coil (coil former) in FIG. 6.

To provide the trailing end 5 of the cable, the cutting means 14 are operated. According to an aspect of the invention, the cutting means 14 are spaced from the coil, or moved to be spaced from the coil, by a distance that is identical or substantially identical to the required length for the trailing end 5 of the coil. The cutting means 14 are shown in FIG. 6 distanced from the coil 3 (coil former 6).

As mentioned above, the length of the trailing end 5 and of the leading end 4 are predetermined by the position of the cutting means 14 and of the second holding means 12 with respect to the coil 3 (or with respect to the coil former 6).

According to a possible embodiment, the method further comprises the step of adjusting the position of the cutting means 14 and/or the position of the second holding means 12. The position can be adjusted within a range that is L−X mm and L+X mm, wherein L is the required length of the free ends 4, 5 of the cable and X is the variation for the required length L (see FIG. 3).

In other words, X is the accepted length variation for the cable, and thus L±X is the range within the required length L can be set. It has to be noted that the value X can be also seen as the accepted tolerance for the cable length L.

The method according to the invention, advantageously comprises the step of adjusting the diameter of the coil former 6 to provide the required length of the cable and the required length of the said free ends 4, 5 of the coiled cable. According to a preferred aspect of the invention, the diameter of the coil former 6 is adjusted for a subsequent coil to be formed on the coil former 6 on the basis of the cable's measured length of the actual processed coil compared to the required length of the cable.

More in detail the method comprises the step of continuously measuring the length of the processed cable and in particular the length of the cable passed after the cutting means 14, i.e. the length of the cable between the leading end and the trailing end. By measuring the cable length and by comparing it with a required length of the cable, the length error due in particular to the variation of the diameter of the cable and due to the differences in relative positions of the turns of the coiled cable, can be determined and used to modify by the control means 18 the diameter of the coil former 6. By doing so, the required length of the cable and the required lengths of the free ends 4, 5 can be reached in the subsequent formed coil.

Preferably, this step is repeated for each coil to continuously adapt the coil former diameter for a subsequent coil on the basis of the length determined for the precedent coil. In fact, in the method, the step of adjusting the diameter of the coil former 6 for a subsequent coil to be formed on said coil former 6 on the basis of the cable's measured length of the actual processed coil, compared to the required length of the cable, is repeated for each coil.

As already mentioned, in connection to the apparatus 1, also the actual measured length of the free ends 4, 5 of the actual processed coil can be used to adjust the diameter of the coil former, preferably by comparing the measured length of the free ends 4, 5 with the required length of the free ends 4, 5 of the coiled cable.

In particular, as mentioned above, the step of adjusting the diameter of the coil former 6 to provide the required length of the cable and the required length of the said free ends 4, 5 of the coiled cable, is carried out by comparing the cable's measured length with the required cable length, preferably memorized (stored) in a memory portion of the control means 18.

Preferably, in the method according to the invention, in the step of adjusting the diameter of the coil former a plurality of coil supporting elements 8 are moved to adjust the diameter. As disclosed above in connection to the apparatus 1, preferably the coil supporting elements 8 are moved with respect to the central axis A by rotation and/or by linear movements.

The method further comprises the step of tying the coiled cable, by suitable tying means 15. At least one tie 16 is provided on the coil, preferably in correspondence of the same exit area 20 of the trailing end 5 and of the leading end 4 from the coil.

It has to be noted, that in the method according to the invention the adjustment of the diameter of the coil former also allows to obtain the required length for the free ends of the cable.

In particular, the adjustment of the diameter allows to have the free ends of the cable in a predetermined position, with respect to the coil, thus allowing the automatic processing of the free ends 4, 5, for example in a cable processing device.

In particular, in the method the diameter is adjusted by control means 18, to obtain a coil 3 wherein the extremities 4*a*, 5*a* of the trailing end 5 and of the leading end 4 are arranged at the same distance D from the external surface S (external diameter) of the coil 3, preferably in correspondence of the exit area 20 of the free ends of the coil. As mentioned above, the distance D is measured between the external surface S of the coil and a plane P that is tangent to the external surface of the coil, preferably in correspondence of said exit area 20 of the free ends 4, 5 from the coil, and externally spaced from the external surface S at distance D.

The method also allows to obtain a coil, wherein the trailing end 5 and the leading end 4 are arranged at the same lateral distance Y from a plane P' passing through the central axis A' of the coil and the exit area 20 of the free ends 4, 5 from the coil.

The coiling apparatus 1 according to the invention can be used in cables or wires processing devices wherein the formed coil, and in particular the free ends thereof can be processed.

As for example shown in FIG. 1, a cables or wires processing device 50 can be provided with at least one coiling apparatus 1. In the shown embodiment of FIG. 1 only one apparatus 1 is provided, however the processing device 50 can be provided with two or more coiling apparatus 1.

According to different embodiments, the device 50 can comprise at least one processing station 51, 52, 53. Means 55 for retaining and moving the free ends 4, 5 of one or more processed coil from the coiling apparatus 1 to the at least one processing station 51, 52, 53, and/or between two or more processing stations 51, 52, 53, if present, can be also provided.

Different configurations of the device 50 can be provided, and the at last one processing station 51, 52, 53 can be selected from at least one station 52 for injection moulding on at least one of said free ends 4, 5 of the coil, preferably on both of said free ends 4, 5, at least one station 51 comprising means for applying electrical connection elements to said at least one of said free ends 4, 5 of the coil, preferably on both of said free ends 4, 5, at least one station 53 comprising means for testing said coil, or a combination of said stations 51, 52, 53. Additional stations, for example intend to perform other process on the cable, and in particular on one or more ends 4, 5 of the coil 3 can be provided. According to a possible embodiment, the station 52 for injection moulding comprises at least one movable injection mould, said at least one mould being translated and/or rotated, in order to increase the number of processed cables while reducing the occupied space.

It has to be noted that support means 56 for the turns 3*a* of said one or more processed coils 3 are provided in order to support it while one, or both ends 4, 5 are retained and moved along the processing stations. The support means 56 for the coil 3 can comprise a movable surface, such as for example a transport support, or a transportation belt, on which the coils 3 are arranged. The support means 5 moves the coil at the same speed of the moving means of the one or more ends of the coils.

In the configuration shown in FIG. 1, the device 50 is provided with a station 51, wherein the coils 3 supplied from two coiling apparatus 1, are prepared by stripping the ends 4, 5, and mounting electrical contact on them.

Subsequently, the coils are transported in correspondence of an injection moulding station 52, preferably a rotary moulding stations, comprising a plurality of moulds (not shown) arranged on a rotatable platform. Also one or more injection unit (injector) are also movable on the rotatable platform.

After the injection moulding step, the coils are transported in subsequent station 53 wherein means for carrying out the electric connection test the coils can be arranged.

A similar cable processing device 50, and in particular a rotary injection moulding station, is disclosed into a patent application in the name of the Applicant (WO2011/077467), to which the coiling apparatus according the present application can be added to provide the cable to be processed. However, the use of the coiling apparatus is not limited to the above disclosed cable processing device 50.

The invention claimed is:

1. An apparatus for coiling a cable or a wire into a coil having a plurality of turns and two free ends formed by a leading end and a trailing end of said cable, said apparatus comprising:

a rotatable coil former around which a cable is coiled;

measuring means for measuring the length of the coiled cable or wire;

first holding means positioned on said coil former for holding the leading end of the cable;

second holding means, separate from said coil former, for receiving and holding the leading end of the cable, said second holding means being movable;

cutting means for cutting the coiled cable to provide a trailing end of the cable; and adjusting means for adjusting a diameter (D1, D2) of the coil former and control means for setting said adjusting means of the diameter of the coil former, to provide a required length of the cable and a required length of said free ends of the coiled cable.

2. The apparatus according to claim 1, wherein said control means set said adjusting means to adjust the diameter for a subsequent coil to be formed on said coil former on the basis of a measured length of a processed coil compared to the required length of the cable.

3. The apparatus according to claim 2, wherein said control means compare the measured length with the required length of the cable, said control means comprising a memory portion whereby said control means memorize the required length of cable for each said coil.

4. The apparatus according to claim 1, wherein said cutting means are spaced from the coil by a distance that is identical or substantially identical to the required length for said trailing end of the coil.

5. The apparatus according to claim 1, wherein said second holding means are spaced from the coil by a distance that is identical or substantially identical to the required length for said leading end of the coil.

6. The apparatus according to claim 1, wherein at least one of a position of said cutting means and a position of said second holding means, is adjustable within a range that is L−X mm and L+X mm, wherein L is the required length of the free end of the cable and X is variation of the required length L.

7. The apparatus according to claim 1, wherein said adjusting means comprises a plurality of coil supporting elements that are radially movable to adjust said diameter of the coil former.

8. The apparatus according to claim 7, further comprising motor means for radially moving said coil supporting elements with respect to a central axis (A) of said coil, wherein said coil supporting elements are displaced by rotation and/or by linear movement.

9. The apparatus according to claim 1, wherein said trailing end and said leading end of the cable exit the coil substantially in correspondence of the same exit area.

10. The apparatus according to claim 9, wherein said cutting means and said second holding means are arranged on two opposite sides with respect to said same exit area.

11. The apparatus according to claim 9, wherein said exit area is arranged substantially on a radial axis (R) passing through a central axis (A) about which said coil former is rotated.

12. The apparatus according to claim 1, wherein said trailing end and said leading end of the cable exit the coil substantially in correspondence of the same exit area, and further comprising a strip of plastic material or a strip of plastic material reinforced with a metal core for providing at least one tie on said coil in said same exit area.

13. The apparatus according to claim 1, wherein said required length of the free ends of the cable is such that extremities of the trailing end and of the leading end are arranged at the same distance (D) from an external surface (S) of the coil.

14. The apparatus according to claim 13, wherein said distance (D) is measured between the external surface (S) of the coil and a plane (P) that is tangent to the external surface of the coil, and externally spaced from said external surface (S) at distance (D).

15. The apparatus according to claim 1, wherein the required length of the free ends is such that the trailing end and the leading end are arranged at the same lateral distance (Y) from a plane (P') passing through a central axis (A') of the coil and an exit area of the free ends from the coil.

16. A cable or wire processing device comprising at least one apparatus for coiling a cable or a wire into a coil having two free ends according to claim 1.

17. A method for coiling a cable or a wire into a coil having a plurality of turns and two free ends formed by a leading end and a trailing end of said cable by an apparatus, said method comprising:

transferring the leading end of the cable to a first holding member positioned on a rotatable coil former for holding the leading end of the cable;

rotating said rotatable coil former for coiling said cable in a plurality of turns;

transferring said leading end of the cable to a second, movable holding member, separate from said coil former;

cutting said cable to provide the trailing end of the cable;

adjusting a diameter of the rotatable coil former to provide a required length of the cable and a required length of the free ends of the coiled cable.

18. The method according to claim 17, wherein the diameter of the rotatable coil former is adjusted for a subsequent coil to be formed on said coil former on the basis of a measured length of a processed coil compared to the required length of the cable.

19. The method according to claim 18, wherein said adjusting the diameter of the rotatable coil former includes repeating said adjusting the diameter of the rotatable coil former for a subsequent coil to be formed on said coil former on the basis of a measured length of a processed cable compared to a required length of the cable for each coil.

20. The method according to claim 17, wherein the step of adjusting the diameter of the rotatable coil former to provide the required length of the cable and the required length of the said free ends of the coiled cable, is carried out by comparing a cable's measured length with the required cable length memorized in a control member.

21. The method according to claim 17, wherein, in said cutting said cable to provide a trailing end, a cutting member is spaced from the coil, or moved to be spaced from the coil, by a distance that is identical or substantially identical to the required length for said trailing end of the coil.

22. The method according to claim 17, wherein said second, movable holding member is spaced from the coil by a distance that is identical or substantially identical to the required length for said leading end of the coil.

23. The method according to claim 17, further comprising adjusting position of a cutting member and/or the position of said second, movable holding member, said position being adjusted within a range that is L−X mm and L+X mm, wherein L is the required length of the free end of the cable and X is variation of the required length L.

24. The method according to claim 17, wherein in said step of adjusting the diameter of the rotatable coil former, a plurality of coil supporting elements are moved with respect to a central axis (A) to adjust the diameter, by rotation and/or by linear movement.

25. The method according to claim 17, further comprising tying the coiled cable by providing at least one tie on said coil at a same exit area of said trailing end and said leading end from the coil.

26. An apparatus for coiling a cable or a wire into a coil having a plurality of turns and two free ends formed by a leading end and a trailing end of said cable, said apparatus comprising:

a rotatable coil former around which a cable is coiled;

measuring means for measuring the length of the coiled cable or wire;

first holding means positioned on said coil former for holding the leading end of the cable;

second holding means, separate from said coil former, for receiving and holding the leading end of the cable, said second holding means being movable;

cutting means for cutting the coiled cable to provide a trailing end of the cable; and adjusting means for adjusting a diameter (D1, D2) of the coil former and control means for setting said adjusting means of the diameter of the coil former, to provide a required length of the cable and a required length of said free ends of the coiled cable, wherein said control means set said adjusting means to adjust the diameter for a subsequent coil to be formed on said coil former on the basis of a measured length of a processed coil compared to the required length of the cable.

* * * * *